US006218939B1

(12) United States Patent
Peper

(10) Patent No.: US 6,218,939 B1
(45) Date of Patent: Apr. 17, 2001

(54) SECURITY AND MONITORING DEVICE FOR AN EMERGENCY EXIT SYSTEM HAVING A DOOR LIGHT OR A WINDOW LIGHT

(75) Inventor: Hendrik Peper, Rutesheim (DE)

(73) Assignee: Geze GmbH & Co., Leonburg (DE)

( * ) Notice: Subject to any disclaimer, the term of this patent is extended or adjusted under 35 U.S.C. 154(b) by 0 days.

(21) Appl. No.: 09/484,422

(22) Filed: Jan. 18, 2000

(30) Foreign Application Priority Data

Mar. 6, 1999 (DE) ..... 299 04 141

(51) Int. Cl.[7] ..... G08B 13/08

(52) U.S. Cl. ..... 340/545.1; 340/547; 340/549

(58) Field of Search ..... 340/545.1, 547, 340/549, 545.6, 545.7, 545.8, 545.9, 555

(56) References Cited

FOREIGN PATENT DOCUMENTS

| | | |
|---|---|---|
| 4009190 | 9/1991 | (DE) . |
| 19541499 | 5/1997 | (DE) . |
| 19625237 | 1/1998 | (DE) . |
| 19641022 | 4/1998 | (DE) . |
| 19652348 | 6/1998 | (DE) . |

*Primary Examiner*—Jeffery Hofsass
*Assistant Examiner*—Daniel Prévil
(74) *Attorney, Agent, or Firm*—Evenson, McKeown, Edwards & Lenahan, P.L.L.C.

(57) ABSTRACT

A security and monitoring device for an emergency exit door has an electrical control device 15 with a microprocessor, an LED current-status display device 11, an emergency off switch device 3, and a key switch device 12 are located in use in a door terminal 20. In order to obtain an especially simple design as well as advantages in assembly and maintenance, provision is made that door terminal 20 is modular in design and control device 15, status display device 11, emergency off switch device 3, and key switch device 12 are designed as modules. These modules are located in under-plaster switch boxes so that an under-plaster arrangement of the terminal is obtained.

24 Claims, 4 Drawing Sheets

SECURITY AND MONITORING DEVICE FOR AN EMERGENCY EXIT SYSTEM HAVING A DOOR LIGHT OR A WINDOW LIGHT

BACKGROUND AND SUMMARY OF THE INVENTION

This application claims priority of DE 29904141.7, filed Mar. 6, 1999, in Germany, the disclosure of which is expressly incorporated by reference herein.

The invention relates to a security and monitoring device for a door or window system as an emergency exit system with at least one window light designed as a door light or window light.

Security and monitoring devices of this kind are so-called RWS systems, in other words escape route systems. They are built into door or window systems in escape and rescue routes. They are emergency exits which are in the closed position during normal operation and are intended to create an exit only in emergencies. Such RWS systems are known for example from German Patent Document DE 196 25 237 A1. The disadvantage of these known devices is that the so-called door control centers mounted near the door, which as a rule have an LED current state display, a key switch for turning the entire device on or off with authorization, and an emergency off switch for shutting off the electrical door-locking device in emergencies, are relatively voluminous. Frequently, the door control center located next to the door also contains an electrical control device with a microprocessor that controls the functions of the security and monitoring device.

RWS door control centers with this design are usually installed in voluminous housings located next to the door and mounted on the wall (product brochure from GEZE "The New RWS").

A likewise relatively voluminous RWS door terminal is known from German Patent Document DE 196 52 348. It has a surface-mounted housing. The key switch unit is designed to be replaceable so that either a conventional mechanical key switch or an electronic code pad or a read device for transponders can be placed in the door terminal.

It is also known from practice to install such RWS door control centers in a correspondingly voluminous housing sunk into the wall under the plaster, as shown for example in the product brochure from the effeff company "Escape Route Guidance Technology" on pages 16 and 17 and in the product brochure from the Dorma company "Door Terminal TL and Accessories" on pages 7 and 8.

It is also known from practice to install operating switches under the plaster in buildings.

Thus, it is known to install electrical light switches and sockets under the plaster.

In addition to the location of electrical switches under the plaster, it is also known to install the operating and control elements for automatic door drives individually under the plaster (product brochure "Plus Point Control Elements" from the GEZE company, pages 7, 5, and 3).

It is also known to mount a programmed timer and operating switches for a control of a shutter drive for windows in a wall under the plaster (http://www.domgy.de/home/gerger/hou/hou2000.shtm "Modernization for Roller Blinds," Somfy company.

An operating unit for a building control system is known from German Patent Document DE 195 41 499 designed as a unit to go beneath the plaster. The operating unit is connected with the building control system through a bus coupler and manual commands and/or measured values can be transmitted to it. The operating unit is provided for accommodation in an individual box under the plaster. A device for arming and disarming an alarm system is known from German Patent Document DE 196 41 022 in which stationary read units and the corresponding antennas are accommodated in a plurality of spatially separate individual boxes beneath the plaster. The read units act together with the alarm system to arm and disarm through switches connected between them.

An under-plaster modular system for an intercom system is known from German Patent Document DE 40 09 190. This under-plaster modular system consists of an under-plaster box designed especially for this application, one or more modular housings, and one or more intermediate housings. The modular housings contain the intermediate housings in the form of frames or boxes into which electrical PC boards or a correspondingly designed device housing can be inserted. The intermediate housings or the instrument housings have electrical connecting buses designed in complementary fashion for the electrical terminals of the modular housing so that when the intermediate housing or the device housing is inserted into the modular housing, the electrical connection is automatically created.

A goal of the invention is to design a security and monitoring device of the type recited at the outset so that it is simpler and unobtrusive.

This goal is achieved by providing a security and monitoring device for a door or window system, preferably an emergency exit system with at least one panel constructed as a door panel or window panel, with a preferably electrical sensor device which determines when the panel is operated in the opening direction and/or when a manual actuating element mounted on the panel is actuated or, when the panel is not in the closed position, a specified opening angle is preferably exceeded, with an electrical alarm display device with acoustic and/or optical alarm display element indicating when the panel is actuated in the opening direction and/or is impacted and/or when a manual actuating element mounted on the panel is actuated or when the panel is not in the closed position, a specified opening angle is preferably exceeded, with an electrical control device preferably with a microprocessor, that processes the signals, preferably electrical signals, from the sensor device and controls the electrical alarm display device, preferably with an electrically switchable locking device for locking and unlocking the panel with the locking device preferably being connected with a manually operable emergency off switch, preferably with a key switch device for authorized switching on and off and/or control of the functions of the security and monitoring device, preferably of the alarm display device and/or the electrically switchable locking device of the panel, preferably with an electrical current-status display device which indicates the position of the door or window panel and/or the current functional status of the security and monitoring device, preferably with an LED display device, wherein the current-status display device and/or the key switch device and/or the emergency off switch and/or the electrical control device and/or the alarm display device and/or a structural unit are designed from a plurality of these components as an add-on module or modules for reception in an under-plaster switch box, with several under-plaster switch boxes being arranged side by side in a row, with a separate add-on module being receivable in each under-plaster switch box.

By locating the various components of the door central control in switch boxes under the plaster, a depressed and unobtrusive arrangement is obtained. With a modular design for the components as a module with a uniform acceptance cross section for use in the corresponding receiving area of the under-plaster switch boxes, further advantages are obtained, namely technical advantages in installation and repair as well as the general advantages of a modular system. The system with a modular design forms a kit system that allows any combination and subsequent expansion using individual modules.

The under-plaster switch box can be designed with standard under-plaster switch boxes. This considerably simplifies installation of the system in buildings and it is also possible to install it subsequently without an anesthetic door terminal next to the door that creates a disturbing visual impression.

Other objects, advantages and novel features of the present invention will become apparent from the following detailed description of the invention when considered in conjunction with the accompanying drawings.

DETAILED DESCRIPTION OF THE DRAWINGS

Figure 1:
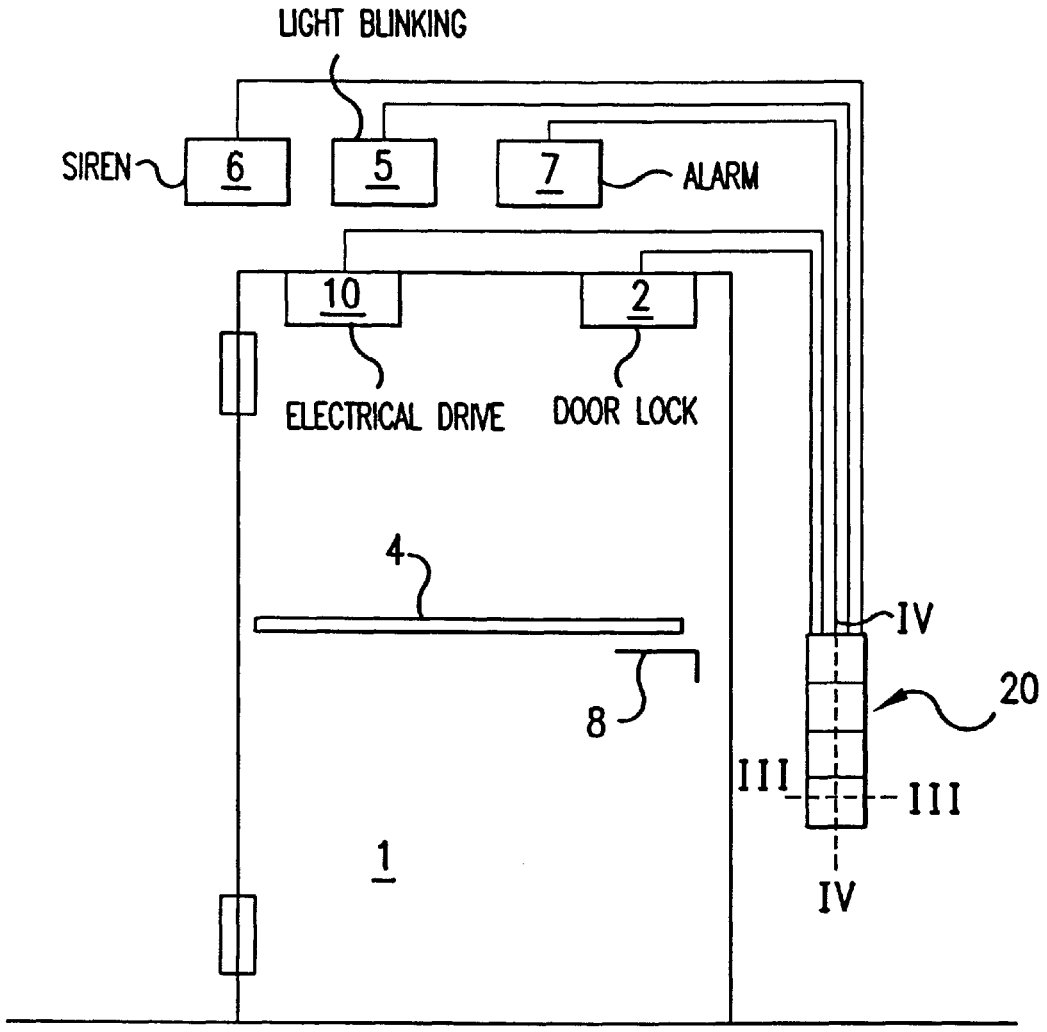
FIG. 1 is a front view of an emergency exit with an escape door provided with an RWS system, looking at the door from inside, constructed according to a preferred embodiment of the invention.

FIG. 1 shows a front view of an emergency exit with escape door 1 which is designed as a hinged-rotating door opening outward. In the normal case, the escape door is closed; it is intended to be opened only in emergencies. At the upper edge of the door is an electrically switchable locking device 2 which keeps the door locked in the normal situation. Door lock 2 for example can consist of a solenoid, an electrical latch, or an electrical door lock mounted in the vicinity of door latch 8. In emergencies, the locking device can be unlocked by an emergency button 3 mounted near the door or by a sensor strip 4 mounted on the door pushbar so that the door can be opened. When the door is opened, a visual and/or acoustic signal is produced by a blinking light 5 or a siren 6 mounted above the door.

A fire alarm 7 mounted above the door can also unlock the door if there is a fire. Fire alarm 7 for example can be designed as a so-called fire alarm system consisting of a fire sensor and alarm electronics.

The functions of door assemblies 2 to 10 are monitored and/or controlled by an automatically operating door control center 20. Door control center 20 is located next to the door and contains an electrical control unit 15 with a microprocessor and an interface. The door control center contains as additional elements as shown in the sectional view of FIG. 4: an emergency off button 3, an LED current status display 11, and a key switch 12. By means of key switch 12, with the aid of a key, the RWS system can be switched off and on by an authorized individual or the alarm can be reset provided other individual functions are switched off and on. The key can be designed as mechanical key or an electronic key for example in the form of code through a keypad in the vicinity of switch 12 or as in electrical access monitoring systems.

Additional assemblies, for example an electrical drive 10 to open the door in emergencies, can also be connected with the door control center. Additional modules with or without their own intelligence can be connected at very low cost to the door control center through an interface.

Each door control center 20 can monitor the respective door autonomously.

Figure 2:
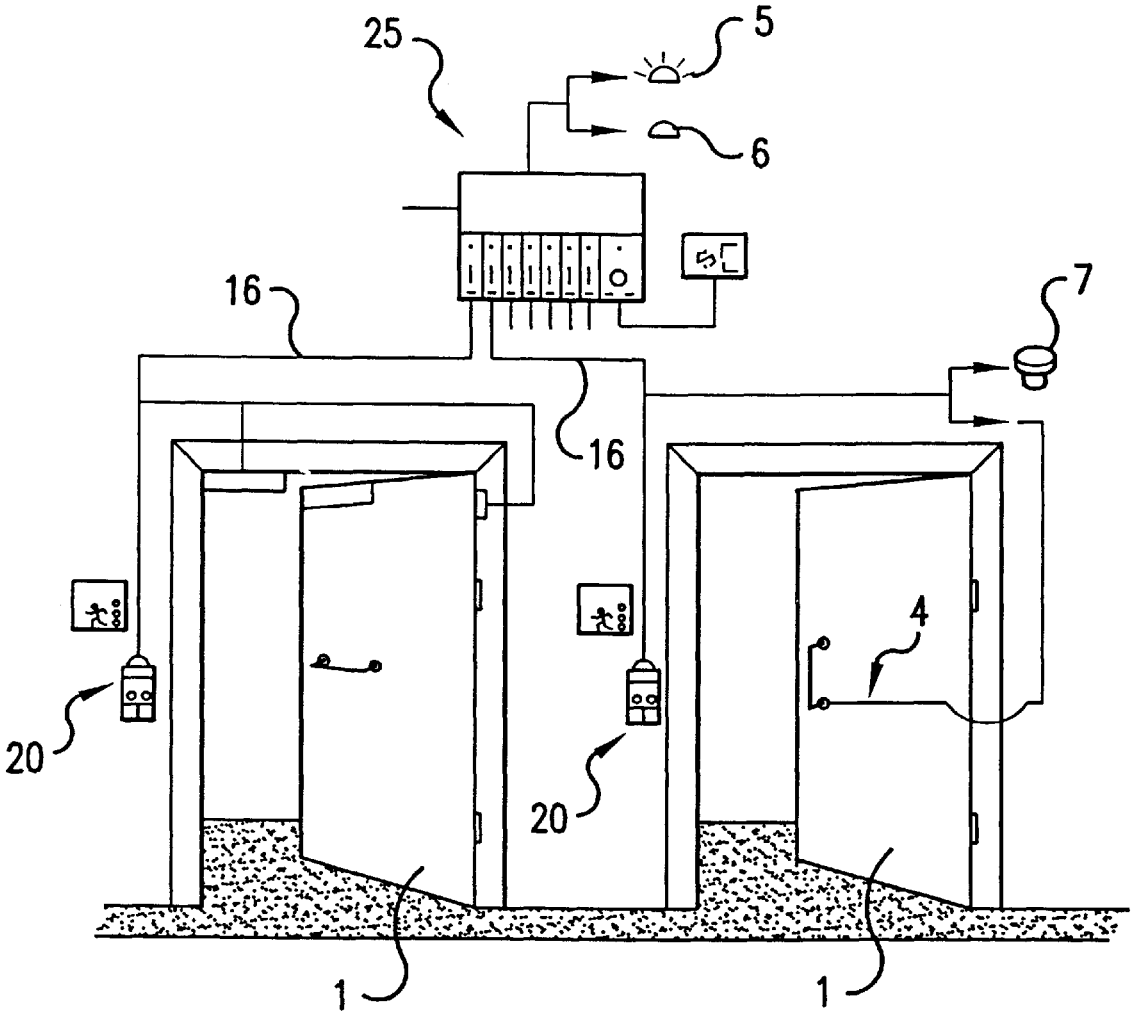
FIG. 2 is a symbolic view of the networking of two door central controls with a multiple door control center, constructed according to a preferred embodiment of the invention.

FIG. 2 shows the connection of two door control centers 20 with a multiple door control center 25 through data transmission lines 16. In the multiple door control center, data are exchanged with several door control centers. The multiple door control center for example can be designed as a separate control center in a gateway and can perform central reporting, monitoring, and alarm functions.

In the embodiments in FIGS. 1 and 2, the door control center 20 located next to the door has a modular design. In the embodiment in FIG. 1, door control center 20 comprises the following modules shown in sectional view in FIG. 4: the electrical control device 15 with microprocessor, the electrical current status display device 11 with LED displays, the emergency off switch device 3, and the key switch device 12. Each of these modules has the same cross section in the plane parallel to the fixed wall. Each of these modules is accommodated in an under-plaster switch box which is sunk into the fixed wall, i.e. sunk into the fixed door frame or the wall bordering the door. The under-plaster switch box is designed like a conventional electrical switch box. It is a standard switch box 90 with a corresponding depth. It has receiving chambers to receive the four modules. It is designed as a quadruple under-plaster switch box, i.e. it has four receiving chambers side by side in a row. Instead of a quadruple under-plaster switch box of this kind, four individual under-plaster switch boxes can be mounted side by side. Additional modules, alarm display devices for example, can be added by providing additional under-plaster switch boxes into which these additional modules can be placed.

Modules 15, 11, 3, and 12 are designed as add-on modules 91 which are accommodated in the receiving chambers of the under-plaster switch boxes 90 so that they are depressed when installed.

Figure 3:
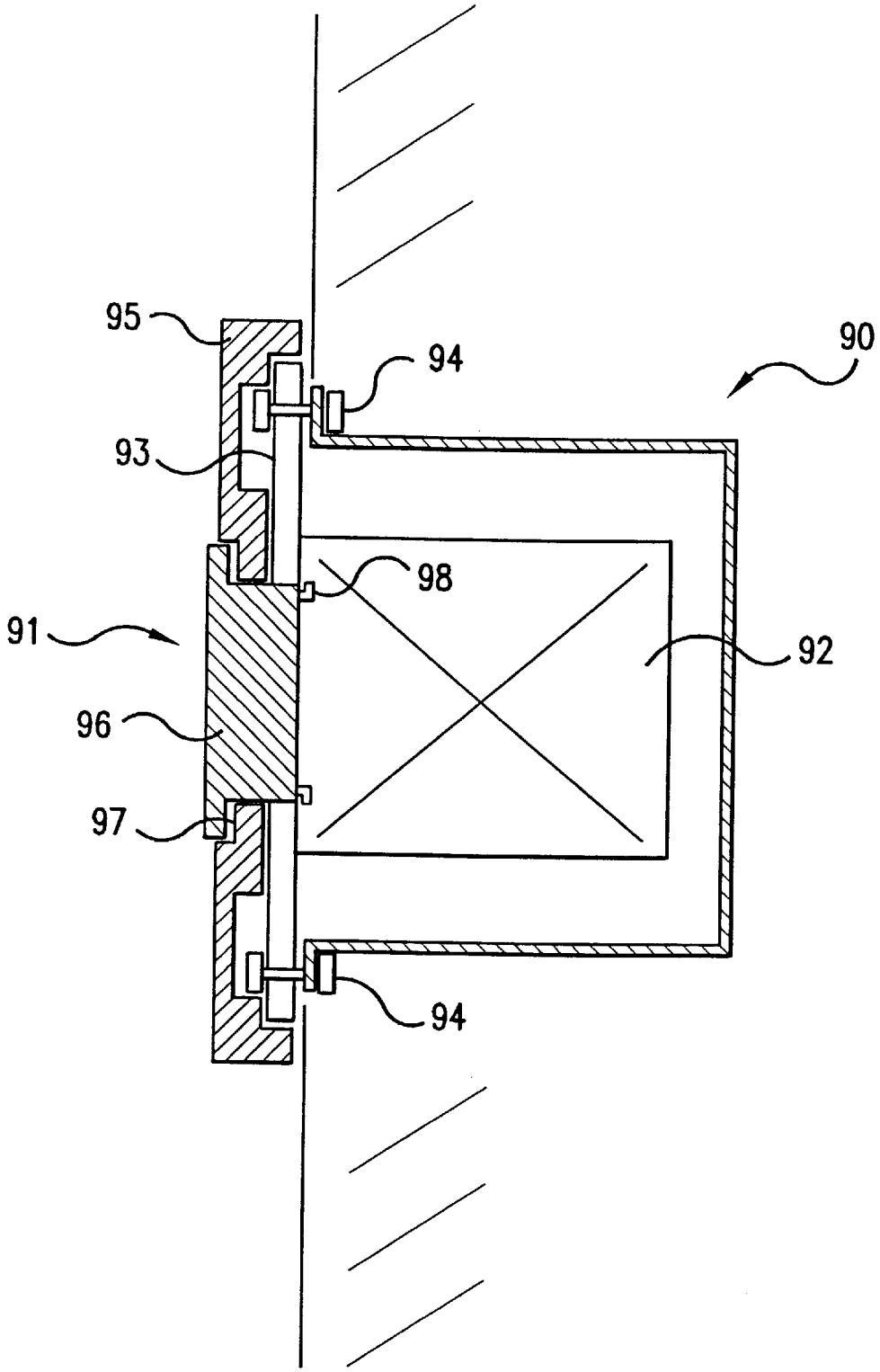
FIG. 3 is a sectional view along line III—III in FIG. 1 in a schematic detailed drawing.
Figure 4:
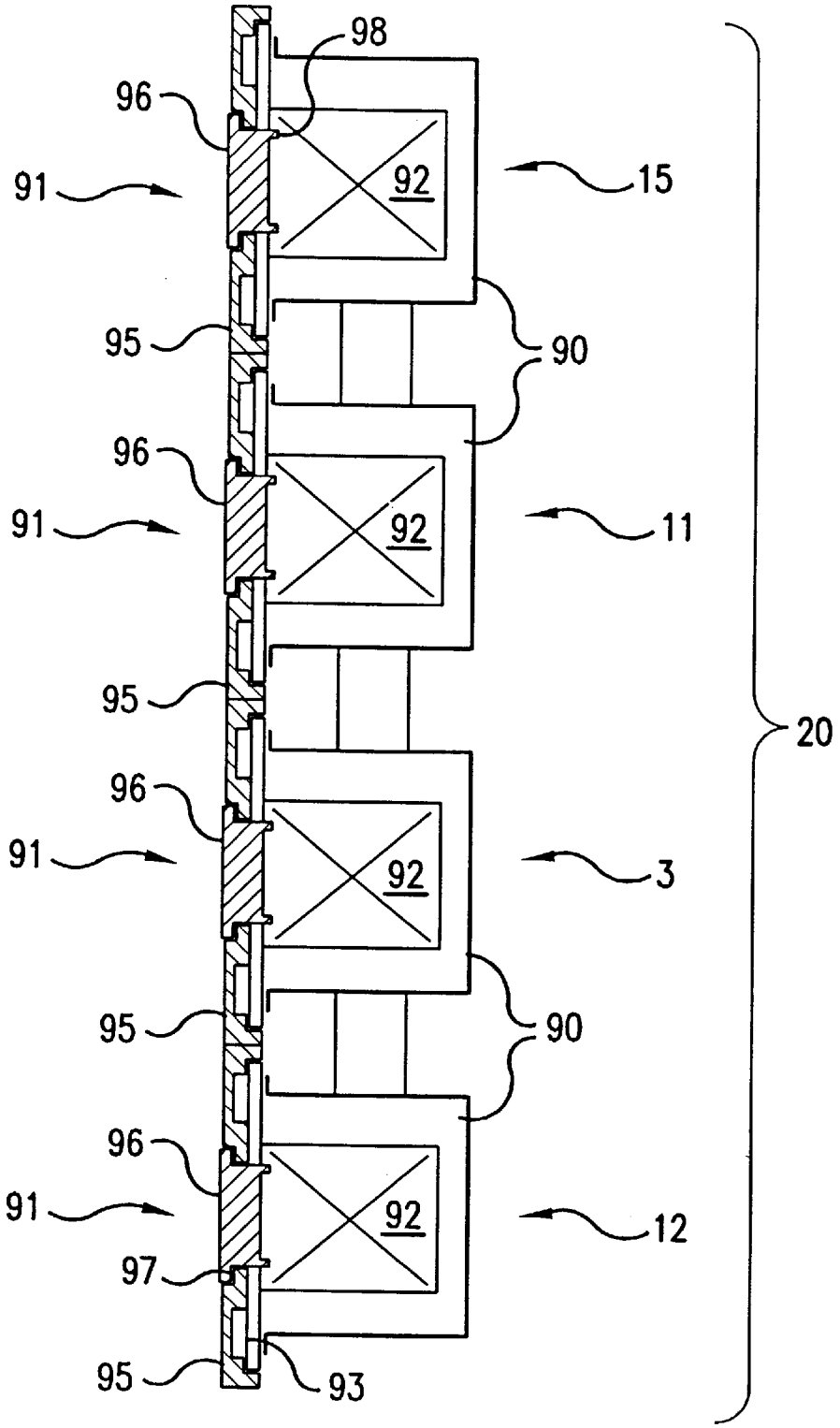
FIG. 4 is a section along line IV—IV in FIG. 1 in a schematic detailed view.

Each add-on module 91 used has a main body 92 with a mounting frame 93 as shown in FIGS 3 and 4. With add-on module 91 inserted into the receiving chamber of the switch box, the mounting frame 93 rests against the outer edge of under-plaster switch box 90 and is screwed by a screw connection 94 to the under-plaster switch box or the adjoining wall. An outer frame device 95 that abuts the outside wall fits over the mounting frame 93 as shown in FIGS. 3 and 4 of add-on module 91. It is held to the wall by the fact that each add-on module 91 has a diaphragm 96 that can be inserted in complementary fashion into a depression 97 in frame device 95 and can be connected by a clip connection with the main body 92 of the add-on module fastened to under-plaster box 90, preferably with mounting frame 93 of the main body through the clip connection. The diaphragm can have elastic tongues 98 on its underside for this purpose that cooperate with mounting frame 93 of main body 92 by latching.

In the embodiment in FIG. 2, door control center 20 is connected with an externally mounted multiple door control center 25. The door control center 20 mounted next to the door can therefore be made simpler in design, in other words without its own intelligence. The control device 15 with microprocessor can therefore be eliminated from control center 20. In door control center 20 there is then no electrical control device or only a simplified one. The actual electrical control device with microprocessor is accommodated in multiple door control center 25. In addition, door control center 20 in the embodiment in FIG. 2 is designed to correspond to door control center 20 in the embodiment in FIG. 1. In other words, door control center 20 in FIG. 2 is likewise modular in design, with the individual modules being designed as add-on modules 91 that are placed in an under-plaster switch box 90 with corresponding receiving chambers. Door control center 20 in FIG. 2 has the following modules: electrical current status display device 11 with LED displays, key switch device 12, and emergency off switch 3.

In the embodiments shown in the figures, the under-plaster switch box is designed as a multiple under-plaster switch box, specifically, in the embodiment in FIG. 1, as a quadruple under-plaster switch box and in the embodiment in FIG. 2, as a double under-plaster switch box. The under-plaster switch boxes are standard switch boxes conventionally employed for electrical sockets.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Security and monitoring device for an emergency exit system with at least one panel constructed as a door panel or window panel, comprising:

an electrical sensor device which determines when the window light is operated in the opening direction and/or when a manual actuating element mounted on the window light is actuated or, when the window light is not in the closed position, specified opening angle is exceeded;

an electrical alarm display device with acoustic and/or optical alarm display element indicating when the window light is actuated in the opening direction and/or is impacted and/or when a manual acutating element mounted on the window light is actuated or when the window light is not in the closed position, a specified opening angle is exceeded;

with an electrical control device with a microprocessor, that processes the electrical signals from the sensor device and controls the electrical alarm display device;

an electrically switchable locking device for locking and unlocking the window light with the locking device being connected with a manually operable emergency off switch;

a key switch device for authorized switching on and off and/or control of the functions of the security and monitoring device, of the alarm display device and/or the electrically switchable locking device of the window light;

an electrical current-status display device which indicates the position of the door or window light and/or the current functional status of the security and monitoring device, with an LED display device;

wherein current-status display device and/or the key switch device and/or the emergency off switch and/or the electrical control device and/or the alarm display device and/or a structural unit are designed from a plurality of these components as an add-on module or modules for reception in an under-plaster switch box.

2. Security and monitoring device according to claim 1, wherein a plurality of under-plaster switch boxes arranged side by side are designed at a module, for example as a double under-plaster switch box, a triple under-plaster switch box, or a quadruple under-plaster switch box.

3. Security and monitoring device according to claim 1, under-plaster switch boxes is designed as a standard switch box with standard dimensions regarding the cross section and/or the depth.

4. Security and monitoring device according to claim 1 wherein the receiving chambers of the under-plaster switch boxes each have the same cross section and/or the add-on modules have the same cross section.

5. Security and monitoring device according to claim 1, wherein each of the under-plaster switch boxes has a receiving chamber that is essentially square and is parallel to a wall closed by the panel, to receive a preferably square add-on module that the essentially complementary in cross section.

6. Security and monitoring device according to claim 1, wherein each of the under-plaster switch boxes can be mounted depressed in a fixed frame of the door or window system or in a wall that adjoins the door or window system.

7. Security and monitoring device according to claim 1, wherein an outer frame device is provided which, when the add-on module is in the under-plaster switch box, surrounds the add-on module and/or fits over the outer edge of the under-plaster switch box.

8. Security and monitoring device according to claim 7, wherein the outer frame device is designed as a common one-piece structural element associated with a plurality of under-plaster switch boxes.

9. A system according to claim 8, wherein an outer frame device is provided which, when the add-on module is in the under-plaster switch box, surrounds the add-on module and/or fits over the outer edge of the under-plaster switch box.

10. Security and monitoring device according to claim 1, wherein the electrical control device and the current-status display and the emergency off switch and the key switch device are designed as respective add-on modules for reception in an under-plaster switch box.

11. Security and monitoring device according to claim 1, wherein each the add-on modules has a main body which is essentially completely submerged in an associated under-plaster switch box when the module is inserted into the under-plaster switch box, whereby provision is made so that the main body is connectable, for example by a screw connection, with the under-plaster switch box and/or the adjoining fixed wall or the adjoining frame of the door or window system.

12. Security and monitoring device according to claim 11, wherein the main body of the respective add-on modules has a mounting frame which, when the main body is inserted into the under-plaster switch box, rests on the outer edge of the under-plaster switch box preferably fitting over the latter, whereby provision is preferably made that, for fixed attachment of the main body of the add-on module, a fastening device is located in the vicinity of the mounting frame.

13. Security and monitoring device according to claim 1, wherein the add-on modules have a diaphragm which, when the add-on module is inserted in the under-plaster switch box, can be mounted on the add-on module and connected with the latter by a fastening connection, whereby the fastening connection is designed as a clip connection.

14. Security and monitoring device according to claim 1, wherein the current-status display device and/or the key switch device and/or the emergency off switch and/or the electrical control device and/or the alarm display device are designed as modules with indentical cross sections parallel to the surface of the fixed frame of the door or window system or the adjoining wall.

15. Security and monitoring device according to claim 14, wherein each of the under-plaster switch boxes is designed as a structural unit for receiving one or more modular add-on modules or that the under-plaster switch box is modular in design, with a plurality of modular design under-plaster switch boxes being capable of being arranged side by side.

16. An emergency room closing panel security and monitoring system, comprising the following components:

an electrical sensor device operable to generate a signal indicative of a panel opening position;

an electrical alarm display device operable by the signal from the electrical sensor device to generate an alarm display;

an electrical control unit including a microprocessor operable to control the alarm display device in response to the signal from the electrical sensor device;

an electrically switchable locking device operable to lock and unlock the door;

a manual operable emergency off switch connectible with the locking device;

a key switch device operable to facilitate authorized control of functions of the alarm display device and the locking device; and an electrical current status display device operable to display at least one of a panel position and current functional status of the security and monitoring system, wherein a plurality of under-plaster switch boxes are arranged side by side adjacent to panel; and wherein respective components of the security and monitoring system are assembled as modules, which modules are received in respective ones of the switchboxes.

17. A system according to claim 16, wherein each of the under-plaster switchboxes are standard switchboxes with standard dimensions of cross section and depth.

18. A system according to claim 17, wherein the modules each have the same cross section.

19. A system according to claim 17, wherein each of the under-plaster switch boxes has a receiving chamber that is essentially square and is parallel to a wall closed by the panel, to receive a square add-on module that is essentially complementary in cross section.

20. A system according to claim 17, wherein each of the under-plaster switch boxes can be mounted depressed in a fixed frame of the door or window system or in a wall that adjoins the door or window system.

21. A system according to claim 17, wherein an outer frame device is provided which, when the add-on module is in the under-plaster switch box, surrounds the add-on module and/or fits over the outer edge of the under-plaster switch box.

22. A system according to claim 16, wherein the room closing panel is a door.

23. A system according to claim 16, wherein the room closing panel is a window.

24. A system according to claim 16, wherein a plurality of panels are provided, and wherein a control unit, including a microprocessor, operably connected with the plural panels is disposed in a common module and switchbox.

* * * * *